US007500864B2

(12) United States Patent
Mase et al.

(10) Patent No.: US 7,500,864 B2
(45) Date of Patent: Mar. 10, 2009

(54) CONNECTOR AND A CONNECTOR ASSEMBLY

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/899,086

(22) Filed: Sep. 4, 2007

(65) Prior Publication Data

US 2008/0057769 A1 Mar. 6, 2008

(30) Foreign Application Priority Data

Sep. 5, 2006 (JP) ..... 2006-240369

(51) Int. Cl.
*H01R 13/627* (2006.01)

(52) U.S. Cl. ..... 439/352; 439/358

(58) Field of Classification Search ..... 439/352, 439/357, 358

See application file for complete search history.

(56) References Cited

U.S. PATENT DOCUMENTS 5,015,199 A 5/1991 Hirano et al.
5,190,467 A 3/1993 Ohta
5,378,168 A * 1/1995 Sumida ..... 439/358
5,399,045 A * 3/1995 Yoneda et al. ..... 403/321
5,679,019 A 10/1997 Sakai et al.
5,830,002 A * 11/1998 Ito et al. ..... 439/358
6,364,618 B1 4/2002 Moreno
6,609,932 B2 8/2003 Fukatsu et al.
6,676,433 B1 1/2004 Ozaki
6,890,204 B2 5/2005 Yamawaki
2001/0046803 A1 11/2001 Kodama
2003/0045153 A1 3/2003 Yamawaki

FOREIGN PATENT DOCUMENTS

JP 2002-203635 7/2002

* cited by examiner

*Primary Examiner*—Tho D Ta
(74) *Attorney, Agent, or Firm*—Gerald E. Hespos; Anthony J. Casella

(57) ABSTRACT

A male housing (10) has a lock (17), whereas a female housing (20) has a resiliently deformable lock arm (31) cantilevered along a connecting direction of the two housings (10, 20). The lock arm (31) deforms in the process of connecting the two housings (10, 20) and resiliently restores upon proper connection to engage the lock (17) for holding the housings (10, 20) connected. The female housing (20) has a first lock protecting wall (36) covering a side of the lock arm (31) including a free end portion (31*b*), and a second lock protecting wall (37) covering a side of the lock arm (31) including base end portions (31*a*). An unlocking space (38) between the first and second lock protecting wall (36, 37) exposes a middle part (31*c*) of the lock arm (31) to the outside.

10 Claims, 13 Drawing Sheets

CONNECTOR AND A CONNECTOR ASSEMBLY

BACKGROUND OF THE INVENTION

1. Field of the Invention

The invention relates to a connector and to a connector assembly.

2. Description of the Related Art

Japanese Unexamined Patent Publication No. 2002-203635 discloses a connector assembly with male and female housings that can be connected together. A lock arm is cantilevered forward on the female housing and has a lock hole that engages a lock on the male housing to hold the housings together. The lock presses and deforms the lock arm in the process of connecting the housings. However, the lock arm is restored resiliently when the housings are connected properly. As a result, the lock enters the lock hole and engages the edge of the lock hole to hold the two housings together. A lock protecting portion is formed on the female housing and covers the front end of the lock arm. Thus, the lock arm cannot be caught and warped by a wire or the like before the housings are connected.

The base end of the lock arm is exposed to the outside in the above-described connector. Thus, an operator may inadvertently place a finger on the lock arm during the connecting operation. A returning movement of the lock arm will be sluggish if the connecting operation is performed while the finger contacts a movable part of the lock arm and might reduce the tactile feeling of the connecting operation.

The invention was developed in view of the above situation and an object thereof is to improve operability.

SUMMARY OF THE INVENTION

The invention is directed to a connector with a housing that is connectable with a mating housing. The housing has a resiliently deformable lock arm that is cantilevered substantially along a connecting direction of the housing with the mating housing. The lock arm has a free front end that is deformable in the process of connecting the housing with the mating housing. The lock arm restores resiliently upon proper connection, and engages a lock of the mating housing to hold the housings connected. The housing further includes a first lock protection that covers the free end of the lock arm and a second lock protection that covers a base end of the lock arm. An unlocking space exists between the first and second lock protections and exposes an intermediate part of the lock arm to the outside.

The invention also relates to a connector assembly comprising the above-described connector and a mating connector connectable therewith.

The free and base ends of the lock arm are covered respectively by the first and second lock protections, and the unlocking space is defined between the two lock protections. Thus, inadvertent contact with the lock arm can be prevented, and a good tactile feeling can be obtained upon performing the connection. The locked state can be canceled by operating a middle part of the lock arm through the unlocking space between the two lock protections.

A displacing direction of the lock arm being unlocked is substantially opposite to an opening direction of the unlocking space. With this arrangement, the locked state easily can be canceled by pressing the middle part of the lock arm through the unlocking space for separating the two housings.

The lock arm preferably has two beams separated from each other by a clearance that communicates with the unlocking space. A coupling couples the free ends of the beams. With this arrangement, a finger or the like can be inserted partly into the clearance between the two beams and into a central position of the lock arm with respect to the width direction. Thus, the lock arm easily can be deformed in the unlocking direction.

Bevels preferably are provided on corners of the beams facing each other and facing the unlocking space. The bevels ensure that the operator will not experience discomfort while pressing the beams with a finger.

The lock enters the clearance between the beams when the housing is connected properly with the mating housing, and the bevels preferably are behind the lock in a properly connected state. Surfaces of the beams facing the lock preferably are substantially parallel to the opposed surfaces of the lock and have no bevel. Therefore, a displacement of the lock arm in the unlocking direction can be prevented even if the two housings shake in width directions relative to each other within the range of a clearance between the beams and the lock in the connected state.

Auxiliary supports preferably couple the lock arm to the housing. Thus, the lock arm preferably has surfaces coupled to and supported on at least one portion of the housing.

The housing or the mating housing preferably includes at least one unlocking-operation guide that faces the unlocking space when the housings are connected properly. The unlocking-operation guide projects more in the opening direction of the unlocking space than the lock arm. Thus, a finger or the like inserted into the unlocking space is guided by the unlocking-operation guide and the second lock protecting portion so that operability is improved further.

The housing or the mating housing preferably includes at least one hitting-sound generating portion arranged on a path of a resilient restoring movement of the lock arm at least at the time of the proper connection. The lock arm starts to return resiliently to a natural state when the housings are connected properly. However, the lock arm collides with the hitting-sound generating portion and generates a hitting sound. Thus, the operator receives a clear audible and tactile indication that a proper connection has been reached.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is described with reference to FIGS. 1 to 13. In this embodiment the connector is fluid- or waterproof and is comprised of a male housing 10 and a female housing 20 that are connectable with each other along a connecting direction CD. Ends of the housings 10, 20 that are to be connected together are referred to herein as front ends and the opposite ends are referred to as the rear ends. Additionally, reference is made to FIGS. 1, 2 and 6 concerning the vertical direction.

Figure 1:
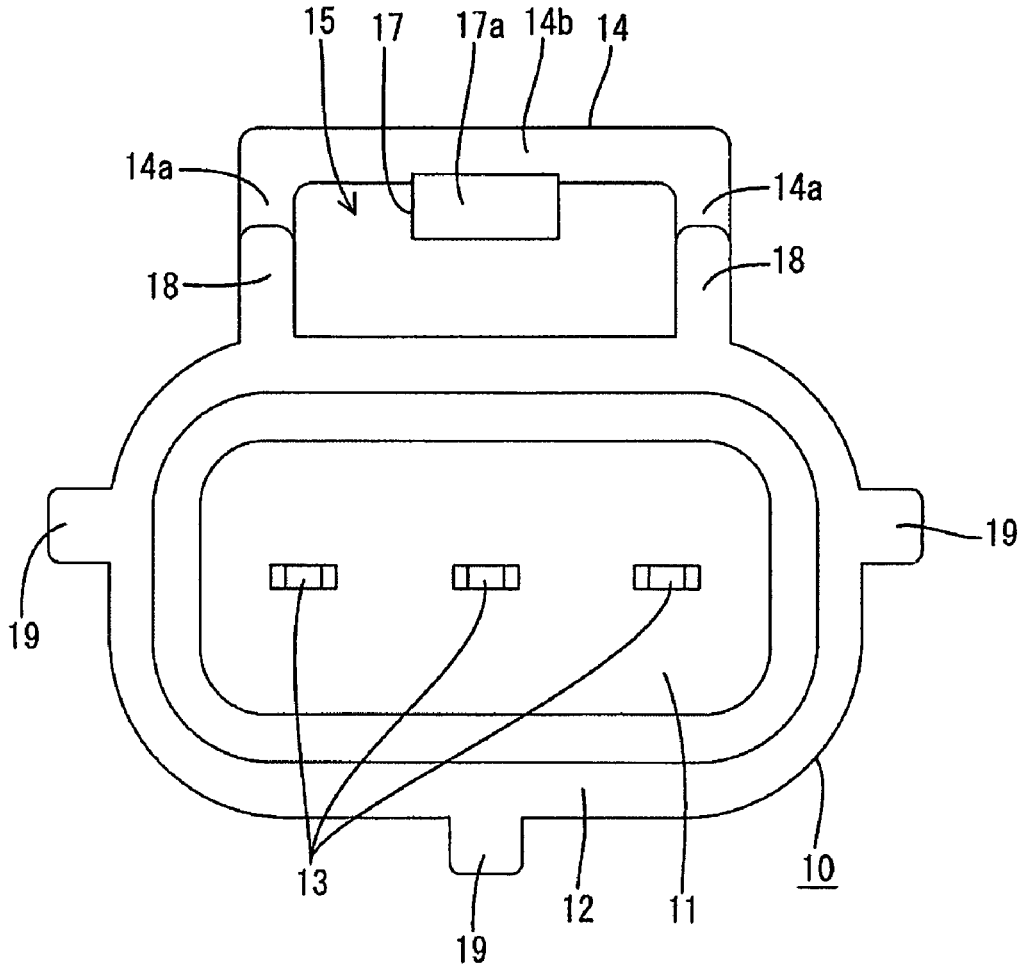
FIG. 1 is a front view of a male housing according to one embodiment of the present invention.
Figure 4:
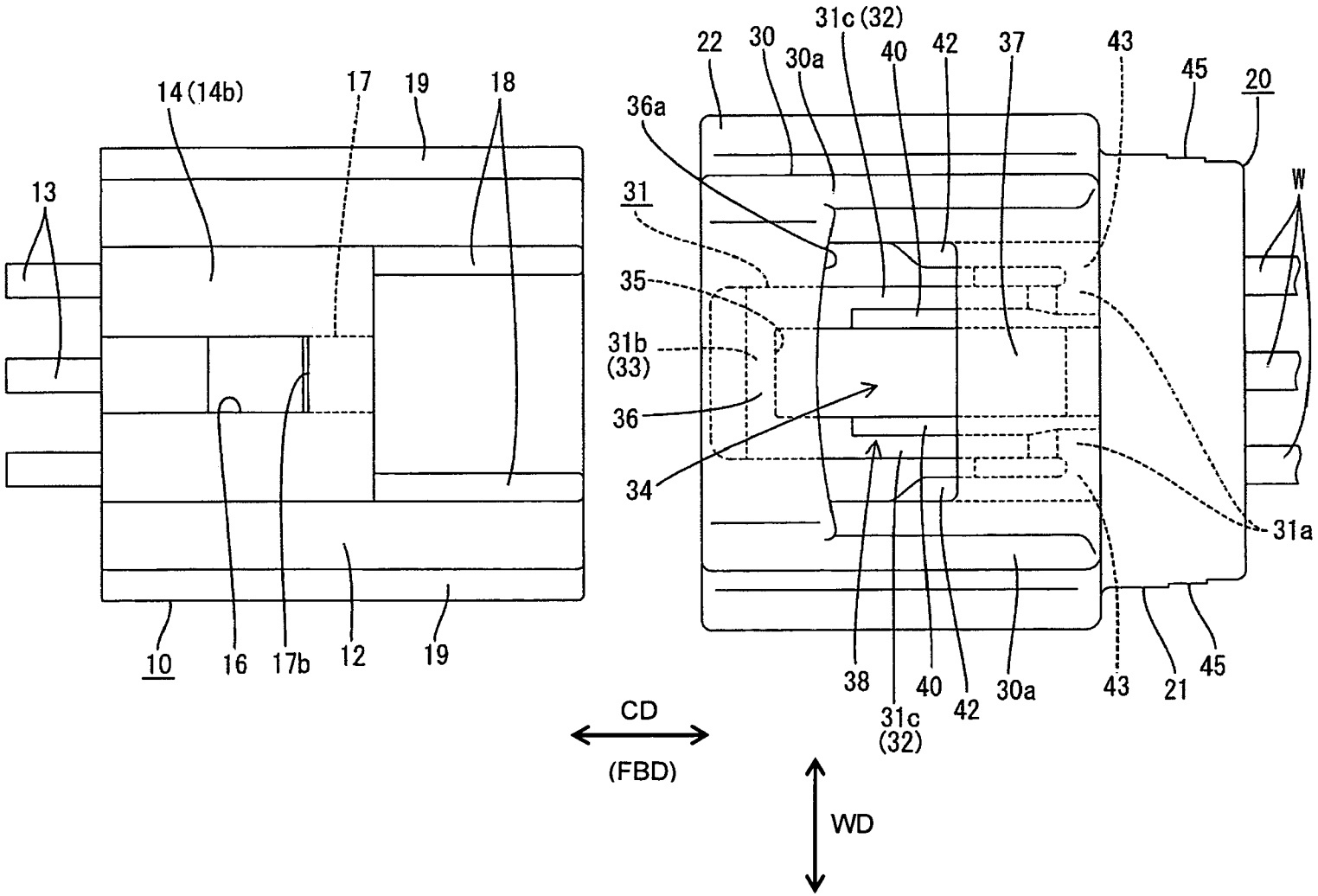
FIG. 4 is a plan view showing a state where the two housings are connected.
Figure 6:
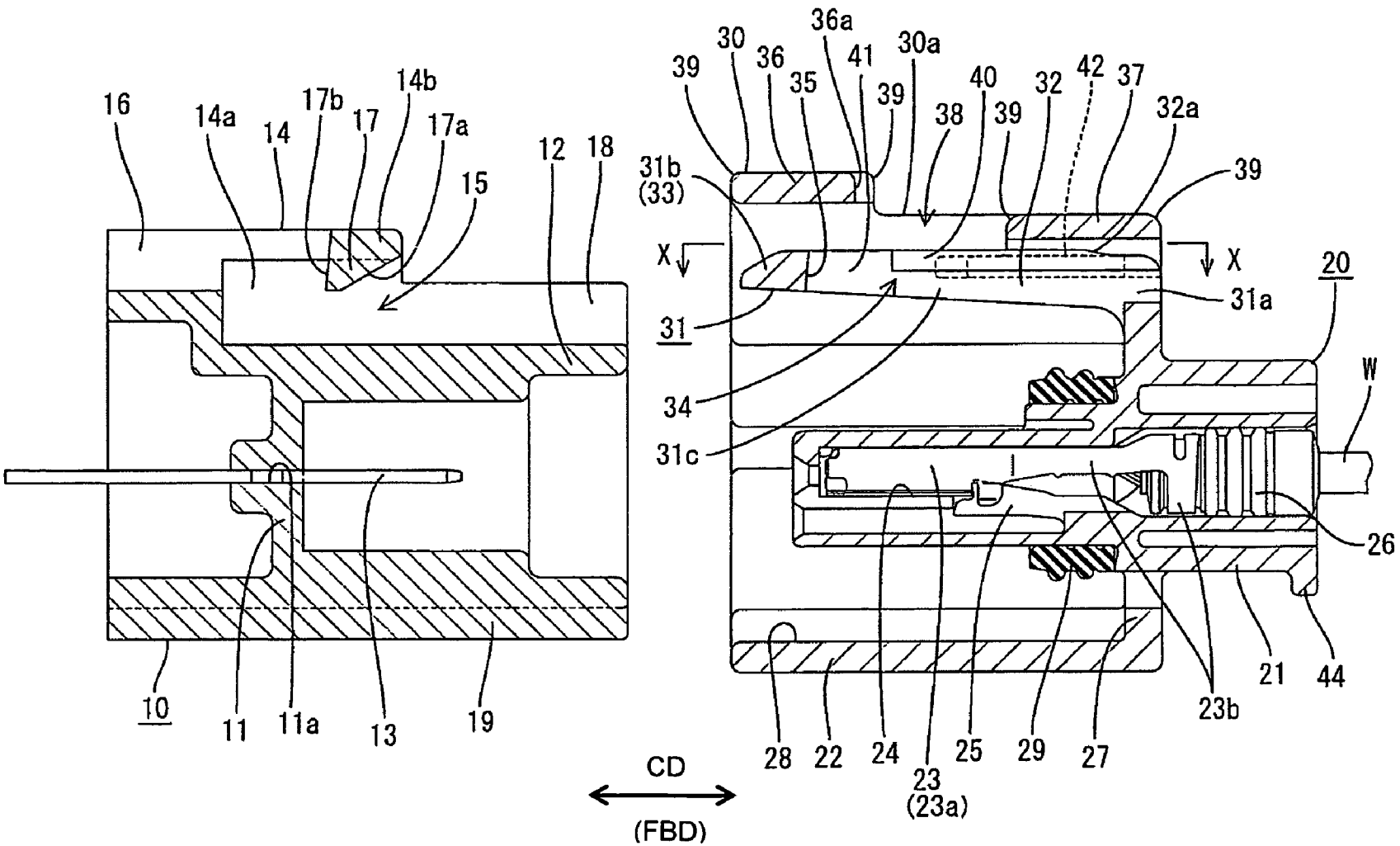
FIG. 6 is a side view in section showing the state before the two housings are connected.

The male housing 10 is made e.g. of synthetic resin and is to be connected directly with a device, such as an electric appliance, a dashboard, a junction box or the like. As shown in FIGS. 1, 4 and 6, the male housing 10 includes a terminal holding wall 11 and a receptacle 12 is connected to the outer periphery of the terminal holding wall 11. Three terminal insertion holes 11*a* penetrate the terminal holding wall 11 in forward and backward directions FBD and are arranged side by side in a width direction WD. Male terminal fittings 13 are insertable into the terminal insertion holes 11*a*. Each male terminal fitting 13 is made of a conductive material, such as metal, and has a front end in the form of a tab that is electrically connectable with a mating female terminal fitting. The rear end of each male terminal fitting 13 is connectable with a wire or with a circuit of the device.

The receptacle 12 is a substantially rectangular tube and has a part that projects back from the terminal holding wall 11 for connection with a casing of the device. An interlocking portion 14 is formed on a rear part of the upper surface of the receptacle 12. The interlocking portion 14 has two side walls 14*a* that project up from the upper surface of the receptacle 12 and a bridging wall 14*b* that couples the upper ends of the side walls 14*a*. A forwardly open lock arm entrance space 15 is defined between the interlocking portion 14 and the upper surface of the receptacle 12.

A rearwardly open groove 16 is formed in a widthwise middle of the bridging wall 14*b* of the interlocking portion 14, and a substantially claw-shaped lock 17 projects down from the front end of the bridging wall 14*b* towards the upper surface of the receptacle 12. The groove 16 is left by rearwardly removing a mold for forming the rear surface of the lock 17. The groove 16 is formed in the entire height range of the lock 17 and in the entire height range of the bridging wall 14*b* to ensure sufficient strength for the mold.

The lock 17 is substantially in the form of a block having substantially the same width as the groove 16. A guiding surface 17*a* is formed at the front end of the lock 17 and slopes down and back from a position at the front end of the bridging wall 14*b*. An interlocking surface 17*b* is formed on the rear of the lock 17 and defines an undercut surface with a steep upward inclination towards the front.

The lower or inner surface of the bridging wall 14*b* of the interlocking portion 14 is lower and more toward the upper surface of the receptacle 12 than the upper surface of the lock arm 31 in its natural state. In other words, since the bridging wall 14*b* is arranged on a path of a resilient returning movement of the lock arm 31 upon proper connection, the returning lock arm 31 collides with the bridging wall 14*b* before the lock arm 31 reaches the natural state. In other words, the bridging wall 14*b* doubles as a hitting-sound generating portion for generating a hitting sound upon receiving the lock arm 31.

Two ribs 18 project from the upper surface of the receptacle 12 before the interlocking portion 14. The ribs 18 align with the side walls 14*a* of the interlocking portion 14 in the width direction WD, and connect with the front ends of the side walls 14*a*. Ribs 19 project from bottom and side surfaces of the receptacle 12 for guiding connection of the housings 10, 20 and preventing connection when the housings 10, 20 are not aligned properly.

The female housing 20 is made e.g. of synthetic resin and has a terminal accommodating portion 21. A substantially rectangular outer tube 22 surrounds the front part of the terminal accommodating portion 21, as shown in FIGS. 2 to 6. A forwardly open space is defined between the terminal accommodating portion 21 and the outer tube 22, and is configured to receive the receptacle 12 of the male housing 10.

The terminal accommodating portion 21 is a wide block, and three female terminal fittings 23 are inserted respectively into three cavities 24 in the terminal accommodating portion 21. The three cavities 24 are arranged substantially side by side in width direction WD in the terminal accommodating portion 21. Locks 25 are cantilevered forwardly from the lower side of the inner surface of each cavity 24. Each lock 25 is resiliently deformable up and down, and the front end of each lock 25 is configured for holding the inserted female terminal fitting 23 in the respective cavity 24.

Each female terminal fitting 23 is formed by press-working (bending, folding, embossing and/or cutting) an electrically conductive metal plate to define a substantially rectangular tubular terminal connecting portion 23*a* and a wire connecting portion 23*b*. The terminal connecting portion 23*a* is connectable with the male terminal fitting 13, and the lock 25 is engageable with a step at the rear end of the terminal connecting portion 23*a*. The wire connecting portion 23*b* is rearward of the terminal connecting portion 23*a* and is configured to be crimped, bent or folded into connection with a resilient plug 26 mounted on the end of the wire W. The plugs 26 are dimensioned to seal the cavities 24.

The rear end of the outer tube 22 is connected with a bulge 27 that projects out from the outer periphery of the terminal accommodating portion 21. The outer tube 22 has an open front end, and recesses 28 are formed in the opposite lateral sides and the bottom of the inner peripheral surface of the outer tube 22 for receiving the ribs 19 of the male housing 10. A seal ring 29 is mounted on the outer peripheral surface of the terminal accommodating portion 21 at a position before the bulge 27. The seal ring 29 is compressed resiliently between the inner peripheral surface of the receptacle 12 of the male housing 10 and the outer peripheral surface of the terminal accommodating portion 21 to provide sealing between the two housings 10, 20.

An extension 30 is raised up at the upper part of the outer tube 22, and a lock arm 31 is arranged in the extension 30. The lock arm 31 has a base 31*a* that stands up from the upper surface of the terminal accommodating portion 21 at the rear end of the lock arm 31 and a free end 31*b* cantilevers forward from the base 31*a*. Portions of the lock arm 31 forward from the base 31*a* are resiliently deformable up and down with the base 31*a* as a support so that the free end 31*b* defines the maximum displacement. The lock arm 31 is displaced down for unlocking, and a deformation permitting space is defined below the lock arm 31 to permit displacement of the lock arm 31. The free end 31*b* of the lock arm 31 narrows gradually towards the leading end. A guidable surface is formed on the front of the free end 31*b* and inclines down towards the front with an inclination conforming to the guiding surface 17*a* of the lock 17. The base ends 31*a* of the lock arm 31 are substantially at the same positions as the bulge 27 with respect to forward and backward directions FBD.

The lock arm 31 has a forked shape defined by two substantially parallel cantilevered beams 32 and a coupling 33 that couples the free ends of the beams 32. A clearance 34 having open upper, lower and rear sides is defined between the two beams 32, and the lock 17 of the male housing 10 can enter the clearance 34 when the two housings 10, 20 are connected. The width of the clearance 34 is substantially equal to or larger than the width of the lock 17 and larger than the width of the beams 32.

Base ends of the beams 32 extend substantially vertically up from the terminal accommodating portion 21. Both beams 32 continue from the base ends along forward and backward direction FBD and along the connecting direction CD. Upper surfaces of both beams 32 are substantially horizontal. However, small inclines 32*a* slope up towards the front at positions immediately before the base ends and the thickness of the beams 32 is increased in parts before the inclines 32*a*. The lower surfaces of both beams 32 are inclined very moderately up towards the front. Therefore, both beams 32 are tapered to gradually decrease their thicknesses towards the free ends.

The coupling 33 is a block that couples the free ends of both arms 32, and a locking surface 35 faces rearwardly on the coupling 33 towards the clearance 34 between the beams 32. The rear surface of the coupling 33 is engageable with the interlocking surface 17*b* of the lock 17 inserted into the clearance 34. The locking surface 35 is undercut with a steep upward inclination towards the back to conform substantially to the interlocking surface 17*b* and to provide a sufficient locking force.

The extension 30 that defines the upper part of the outer tube 22 is comprised of two side walls 30*a* and a bridging wall that bridges the upper ends of the both side walls 30*a*. The bridging wall is divided into a first lock protecting wall 36 for covering the free end 31*b* of the lock arm 31 and a second lock protecting wall 37 for covering the base ends 31*a* of the lock arm 31. An unlocking space 38 is defined between the spaced apart first and second lock protecting walls 36, 37.

The first lock protecting wall 36 is a substantially flat plate that extends back substantially parallel to the lock arm 31 from the front end of the female housing 20, and covers the free end 31*b* of the lock arm 31 over substantially the entire width from above. Thus, the free end 31*b* of the lock arm 31 cannot be caught by the wire W or the like before the connecting operation is started, and the lock arm 31 will not be warped. The first lock protecting wall 36 is arranged at a height so that a space between the lock arm 31 and the first lock protecting wall 36 permits entry of the interlocking portion 14 of the male housing 10 upon proper connection. The first lock protecting wall 36 has a length to at cover an area of the lock arm 31 including substantially the entire free end 31*b* and a part behind the free end 31*b*. The rear end of the first lock preventing wall 36 is at an intermediate position of the interlocking portion 14 of the male housing 10 at proper connection. In other words, the front end of the interlocking portion 14 projects back from the first lock protecting wall 36 towards the unlocking space 38 at the time of the proper connection.

The front end of the first lock protecting wall 36 is substantially straight along the width direction WD, whereas a rear end 36*a* thereof is curved along width direction (see FIG. 4). More specifically, the rear end 36*a* of the first lock protecting wall 36 has a substantially concave arched shape that is retracted moderately forward from the opposite widthwise ends towards the widthwise center. Accordingly, the length of the unlocking space 38 behind the first lock protecting wall 36 in forward and backward directions FBD is longer by the forward retracted amount of the rear end surface 36*a* of the first lock protecting wall 36 and is longest in the widthwise center.

The second lock protecting wall 37 is a substantially flat plate that extends forward parallel with the lock arm 31 from the rear end of the outer tube 22, and covers the base ends 31*a* of the lock arm 31 from above over substantially the entire widths. The second lock protecting wall 37 is longer than the first lock protecting wall 36 and is dimensioned to cover an area of the lock arm 31 including the entire base ends 31*a* and parts before the base ends 31*a*. Accordingly, the second lock protecting wall 37 covers more of the lock arm 31 than the first lock protecting wall 36. Thus, a part of the lock arm 31 that is exposed through the unlocking space 38, i.e. a part of the lock arm 31 to be operated for unlocking, is displaced towards the free end.

The second lock protecting wall 37 is lower than the first lock protecting wall 36. Thus, a clearance between the second lock protecting wall 37 and the lock arm 31 is smaller than the clearance between the first lock protecting wall 36 and the lock arm 31 and is smaller than a finger F of an operator. Therefore, the finger F of the operator or other external matter cannot enter the clearance between the second lock protecting wall 37 and the lock arm 31 from behind to interfere with the lock arm 31.

The finger F of the operator holding the female housing 20 may be placed on the first or second lock protecting walls 36 or 37 during connecting or separating operations. Accordingly, rounded surfaces 39 are formed on the upper or outer corners of the front and rear ends of the lock protecting walls 36, 37. Thus, pressure on the finger F of the operator is reduced to mitigate pain to the operator. In other words, the rounded surfaces 39 of both lock protecting walls 36, 37 can be utilized actively as operable portions for the connecting and separating operations.

An intermediate part 31*c* of the lock arm 31 between the free end 31*b* and the base ends 31*a* is exposed upward through the unlocking space 38 in a direction substantially normal to forward and backward directions FBD. Thus, the intermediate part 31*c* of the lock arm 31 can be operated from the outside above. This upward direction in which the unlocking space 38 is open is substantially opposite to a downward direction in which the lock arm 31 is displaced during unlocking. This unlocking space 38 communicates with the clearance 34 between the beams 32 of the lock arm 31. Therefore, the operator can unlock the lock arm 31 while inserting the finger F through the unlocking space 38 into the clearance 34 between the both beams 32. A position of the lock arm 31 pressed by the operator at this time is substantially in the widthwise center.

Bevels 40 are provided at the inner corners of the beams 32 of the lock arm 31 facing each other and facing the unlocking space 38. The bevels 40 are chamfered, inclined, slanted or rounded surfaces that extend obliquely up, and are moderately rounded at the upper and lower ends. Each bevel 40 is formed in a range defined by about half the thickness (height) and about half the width of the beam 32.

The bevels 40 are formed to expose the inner corners of the beams 32 towards the back side, and the front ends of the bevels 40 are at positions behind the free ends 31*b*. More specifically, the front ends of the bevels 40 are distanced backward from the locking surface 35 of the lock arm 31 by about the length of the lock 17. Facing surfaces 41 are left at sides of the inner surfaces of the beams 32 before the bevels 40. The facing surfaces 41 face the side surfaces 17*c* of the lock 17 and are substantially parallel to the side surfaces 17*c*. The side surfaces 17*c* of the lock 17 and the facing surfaces 41 of the beams 32 facing the lock 17 are substantially straight surfaces that extend vertically along a direction that is substantially normal to the forward and backward directions FBD (see FIG. 11).

Figure 8:
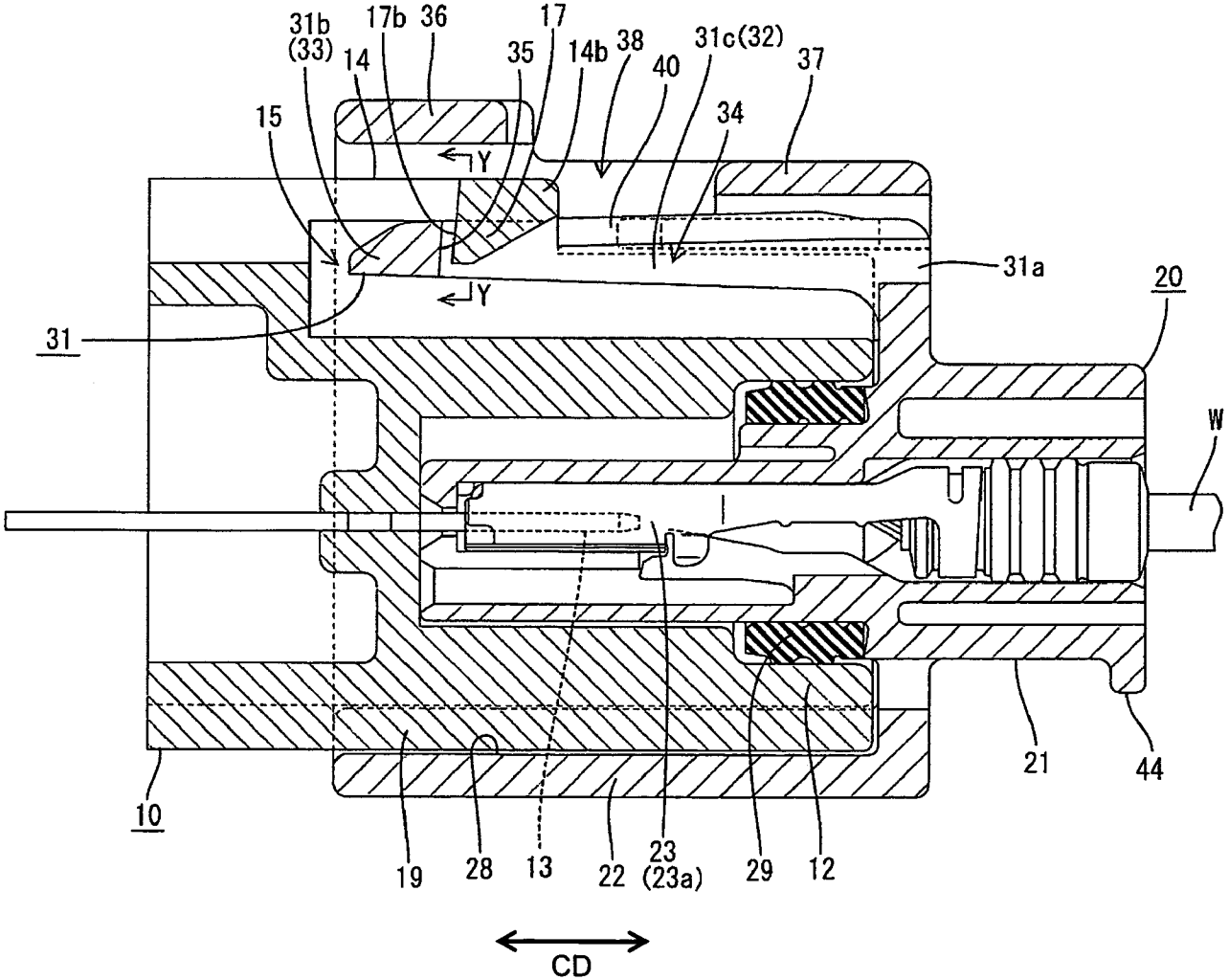
FIG. 8 is a side view in section showing a state where the two housings are properly connected.

With the two housings 10, 20 properly connected, the bridging wall 14*b* of the interlocking portion 14 is between the lock arm 31 and the first lock protecting wall 36, i.e. located more upward than the lock arm 31, as shown in FIG. 8. Additionally, the bridging wall 14*b* of the interlocking portion 14 is lower and more inward than the second lock protecting wall 37 arranged therebehind with the unlocking space 38 located between them. However, at least one part of the bridging wall 14*b* and the second lock protecting wall 37 substantially face each other in forward and backward directions FBD. The finger F of the operator inserted into the unlocking space 38 during unlocking is guided by the bridging wall 14*b* of the interlocking portion 14 and the second lock protecting wall 37. Thus, the bridging wall 14*b* doubles as an unlocking-operation guide.

The side walls 30*a* of the extension 30 are dimensioned to cover the lock arm 31 from opposite sides and to cover the interlocking portion 14 of the male housing 10 from opposite sides in a properly connected state. Further, rib receiving portions 42 project in from opposite inner surfaces of the side walls 30*a* of the extension 30 for receiving the ribs 18 of the male housing 10. The rib receiving portions 42 are arranged on rear portions of the side walls 30*a* and the front ends of the rib receiving portions 42 face the unlocking space 38. The front end surfaces of the rib receiving portions 42 are slanted (see FIG. 4).

Figure 2:
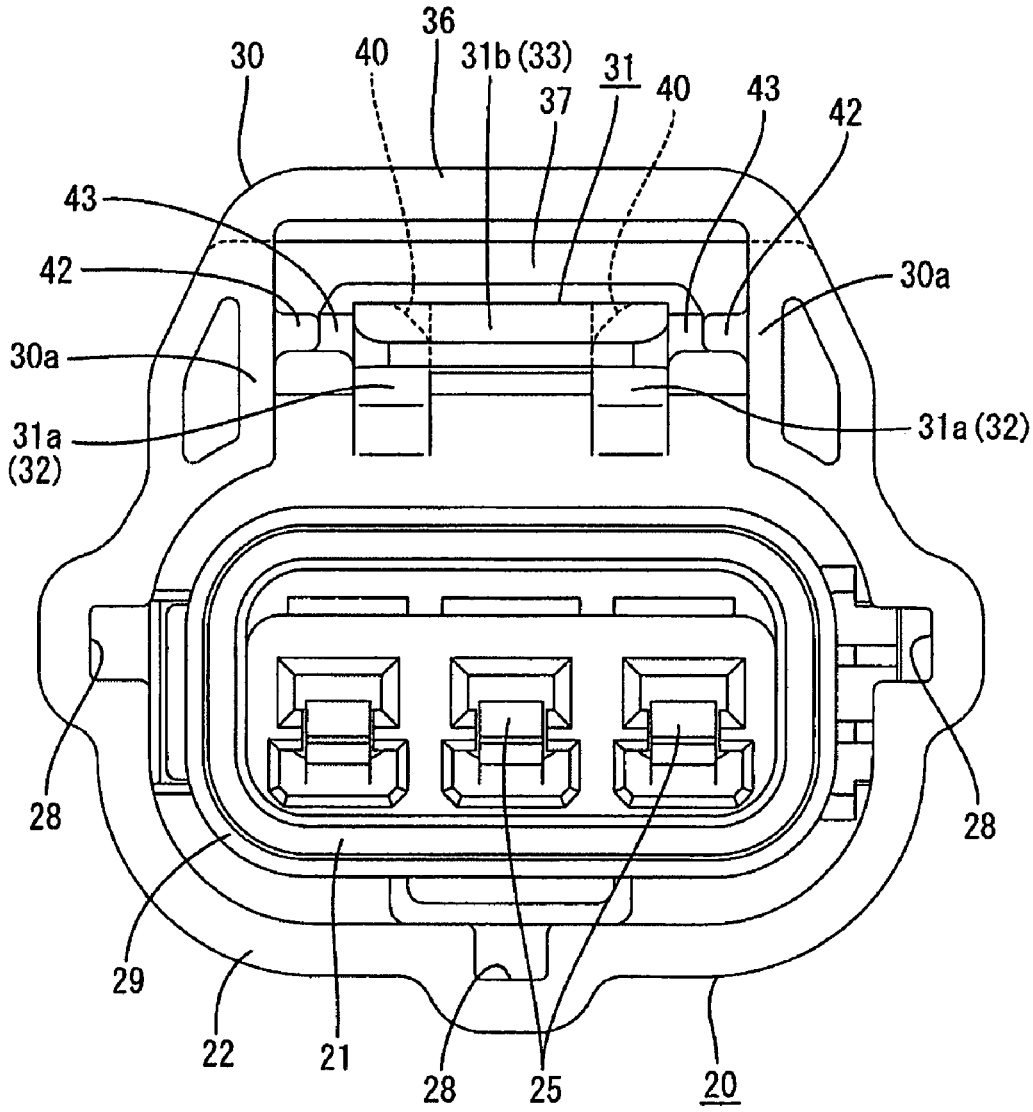
FIG. 2 is a front view of a female housing.
Figure 5:
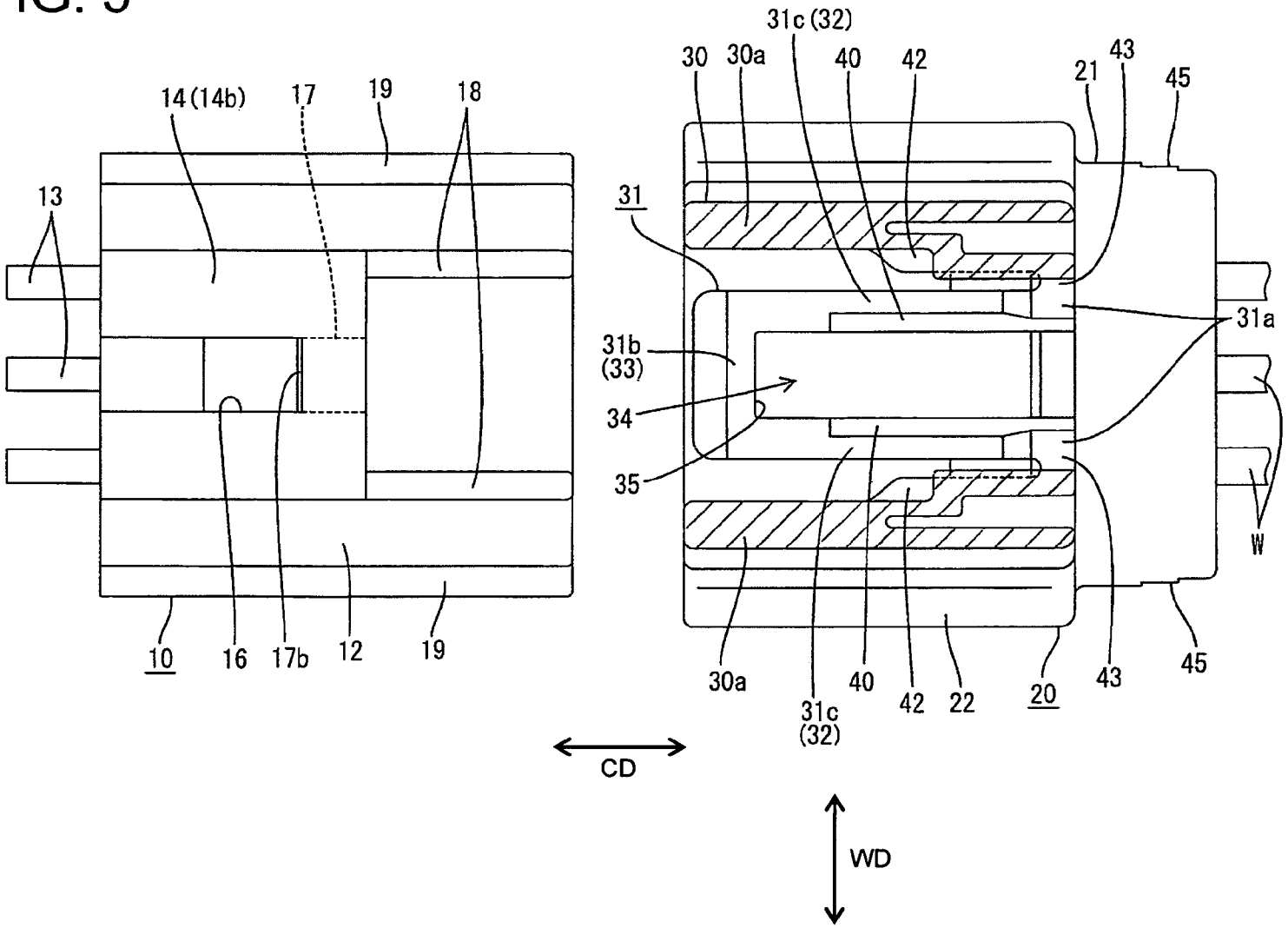
FIG. 5 is a section along X-X of FIG. 6 showing a state before the two housings are connected.

Auxiliary supports 43 are coupled to upper parts of the side surfaces of the base ends 31*a* of the lock arm 31 and project farther in from the rear ends of the rib receiving portions 42 (see FIGS. 2 and 5). Accordingly, the lower surfaces of the base ends 31*a* of the lock arm 31 are coupled to and supported on the terminal accommodating portion 21, and the side surfaces thereof are coupled to and supported on the opposite side walls 30*a* of the extension 30 via the auxiliary supports 43 and the rib receiving portions 42 so that sufficient strength is ensured for the lock arm 31.

Figure 3:
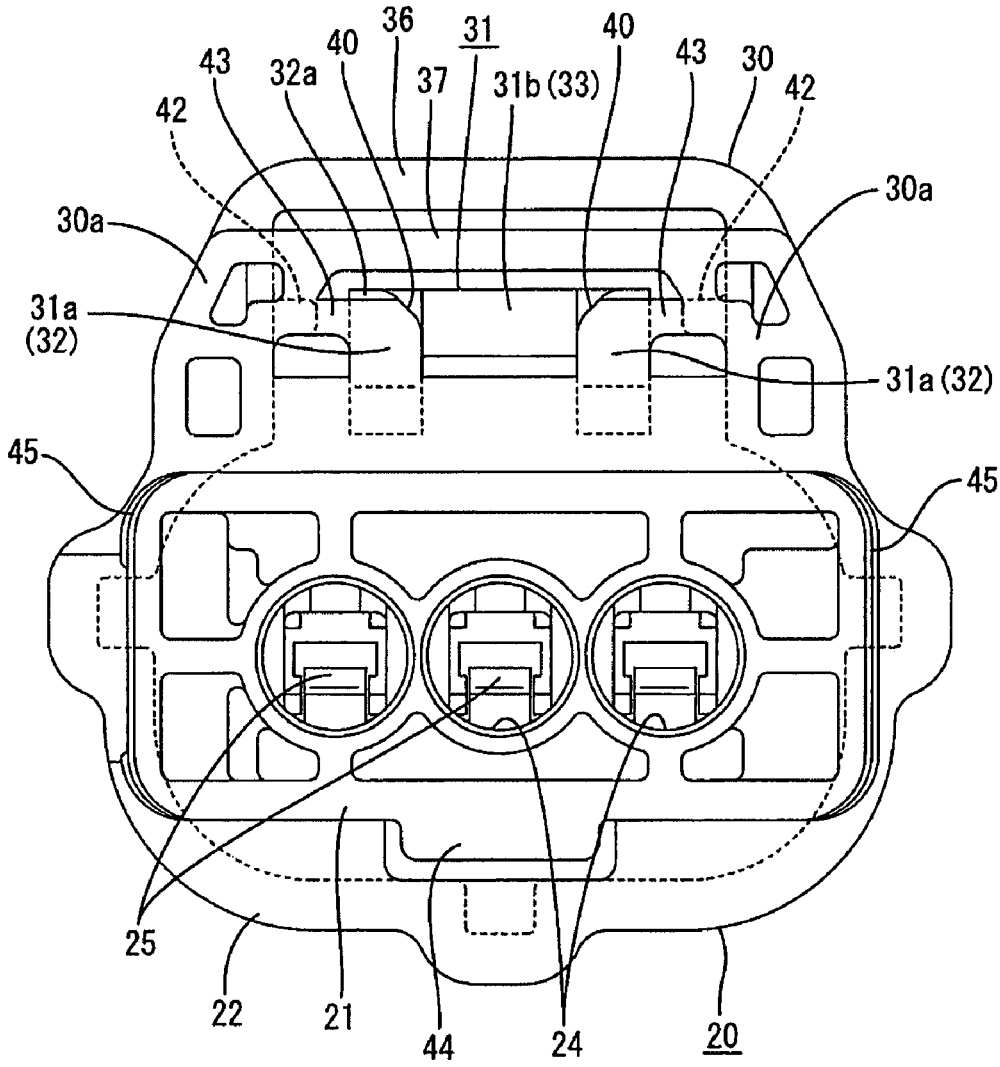
FIG. 3 is a rear view of the female housing.

A protrusion 44 projects down from the lower surface of the rear end of the terminal accommodating portion 21 (see FIG. 6), and steps 45 are on opposite outer side surfaces of a part of the terminal accommodating portion 21 behind the outer tube 22 (see FIGS. 3 and 4). The protrusion 44 and steps 45 can be maneuvered by an operator to connect or separate the housings 10, 20.

The front and rear lock protecting walls 36, 37 are unitary to the female housing 20 in which the lock arm 31 is provided, and constantly protect the lock arm 31 from interference of external matter. Thus, the lock arm 31 cannot be caught by the wires W or the like and warped before the two housings 10, 20 are connected, e.g. in the process of transporting the female housing 20 from a site where the female terminal fittings 23 are assembled into the female housing 20 to a site where the two housings 10, 20 are connected.

Figure 7:
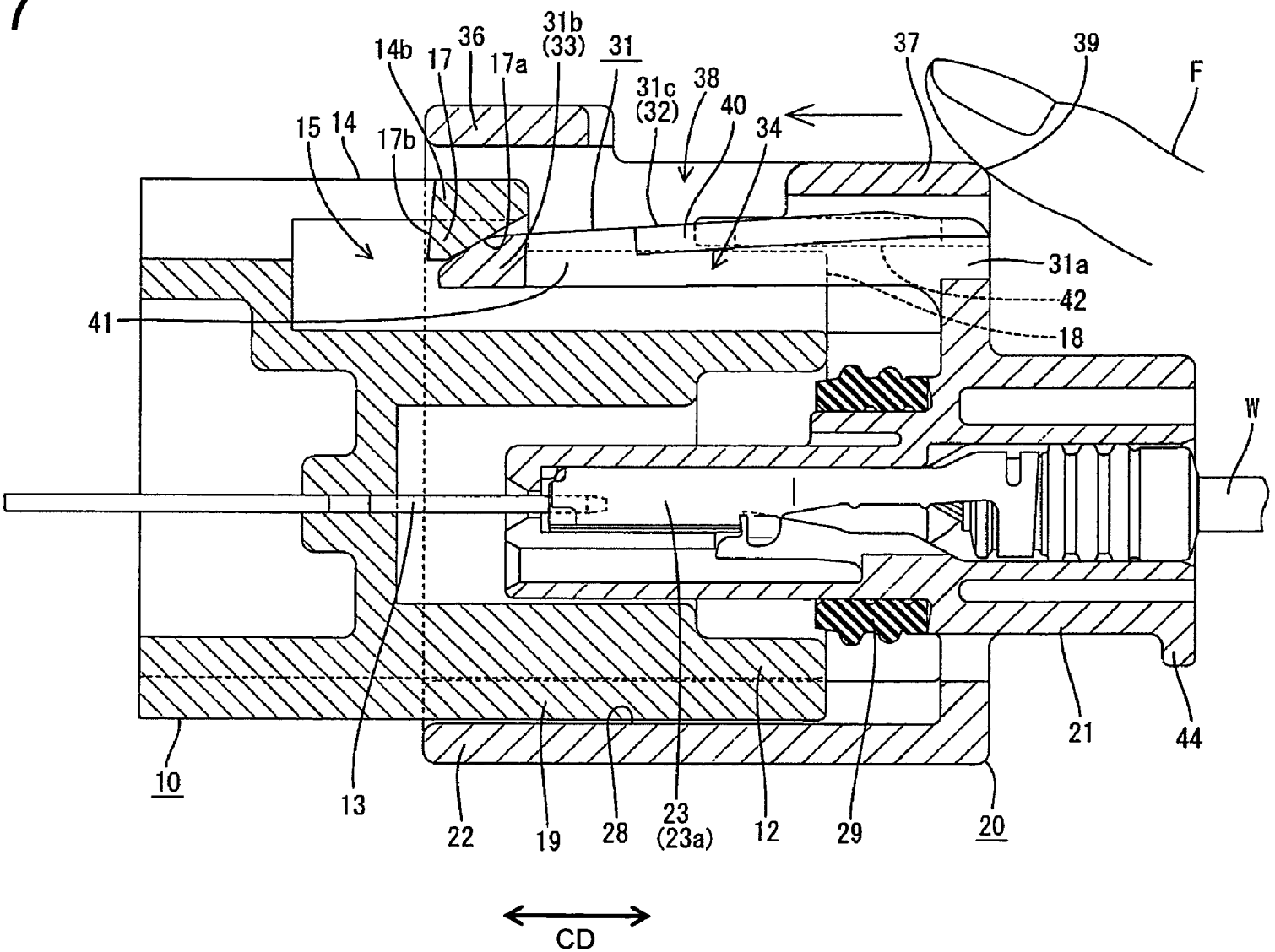
FIG. 7 is a side view in section showing an intermediate state of a connecting operation of the two housings.

The receptacle 12 of the male housing 10 is fit along the connecting direction CD (forward and backward directions FBD) into a space between the terminal accommodating portion 21 and the outer tube 22 of the female housing 20 in the state shown in FIGS. 4 to 6. Thus, the guiding surface 17*a* of the lock 17 guides the free end 31*b* of the lock arm 31 down and in, as shown in FIG. 7, and the lock arm 31 is deformed resiliently down in a direction intersecting the connecting direction CD, with the base ends 31*a* as the supports. At this time, parts of the lock arm 31 adjacent the base ends 31*a* are covered by the second lock protecting wall 37, parts of the lock arm 31 adjacent the free end 31*b* are covered by the first lock protecting wall 36, and the unlocking space 38 is exposed upward. Thus, a finger F of an operator cannot inadvertently contact the movable part of the lock arm 31 while pushing the female housing 20 from behind during the connecting operation. The rear surfaces of the base end portions 31*a* of the lock arm 31 are exposed backward to the outside. However, the base ends 31*a* are immovable parts that are not displaced as the lock arm 31 is deformed. Therefore, contact of a finger F with the base ends 31*a* is not likely to affect the displacement of the lock arm 31 adversely.

An operator who pushes the second lock protecting wall 37, as shown in FIG. 7, can proceed with the connecting operation without touching the movable part of the lock arm 31. The second lock protecting wall 37 on the top of the female housing 20 can be utilized as an operable portion for the connecting operation in addition to the protrusion 44 on the bottom surface of the female housing 20 and the steps 45 on the opposite side surfaces. Thus, there are several areas on the female housing 20 that can be held, to provide a high degree of freedom in holding posture and improved connection operability.

Figure 9:
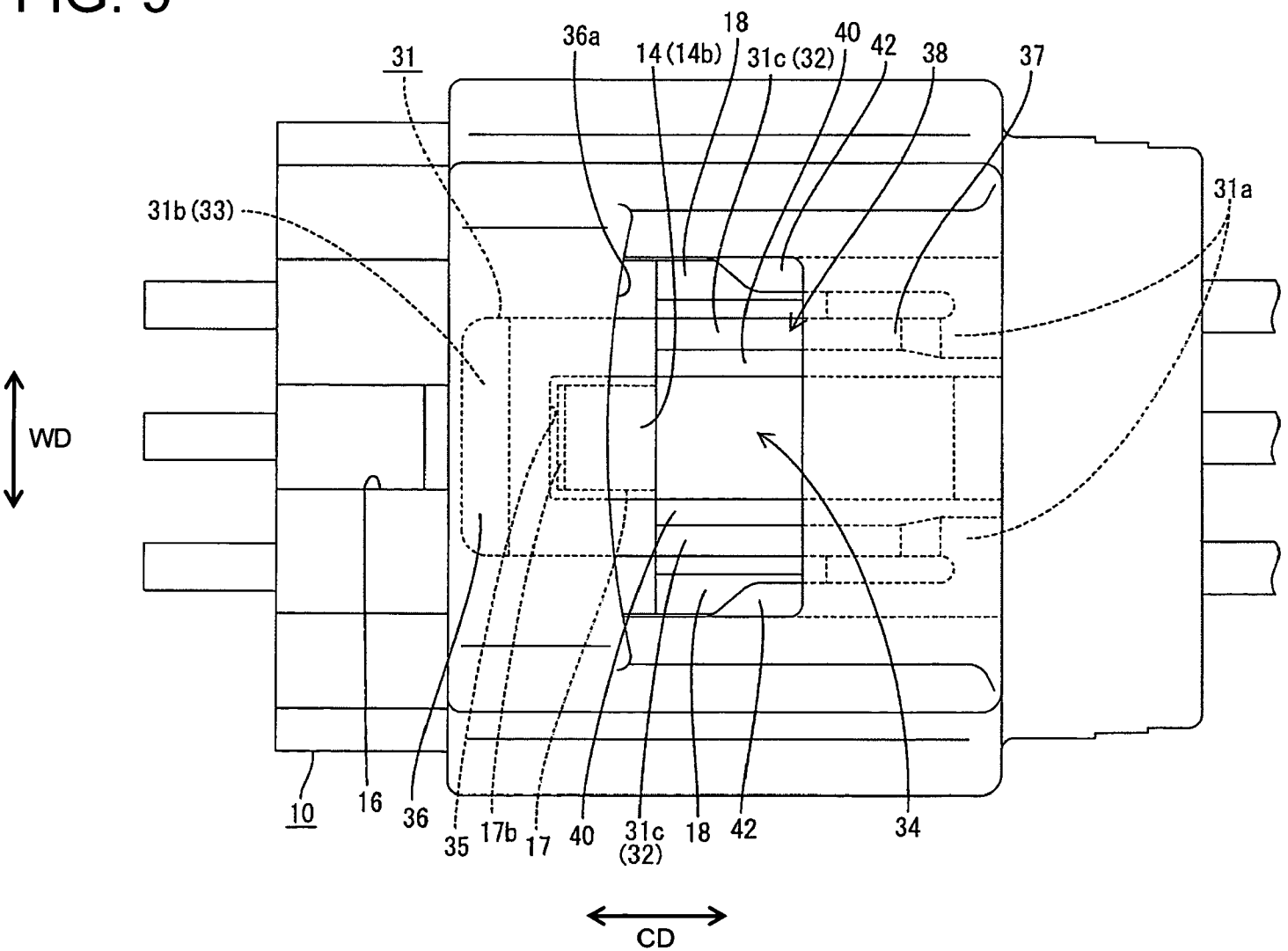
FIG. 9 is a plan view showing the state where the two housings are properly connected.
Figure 10:
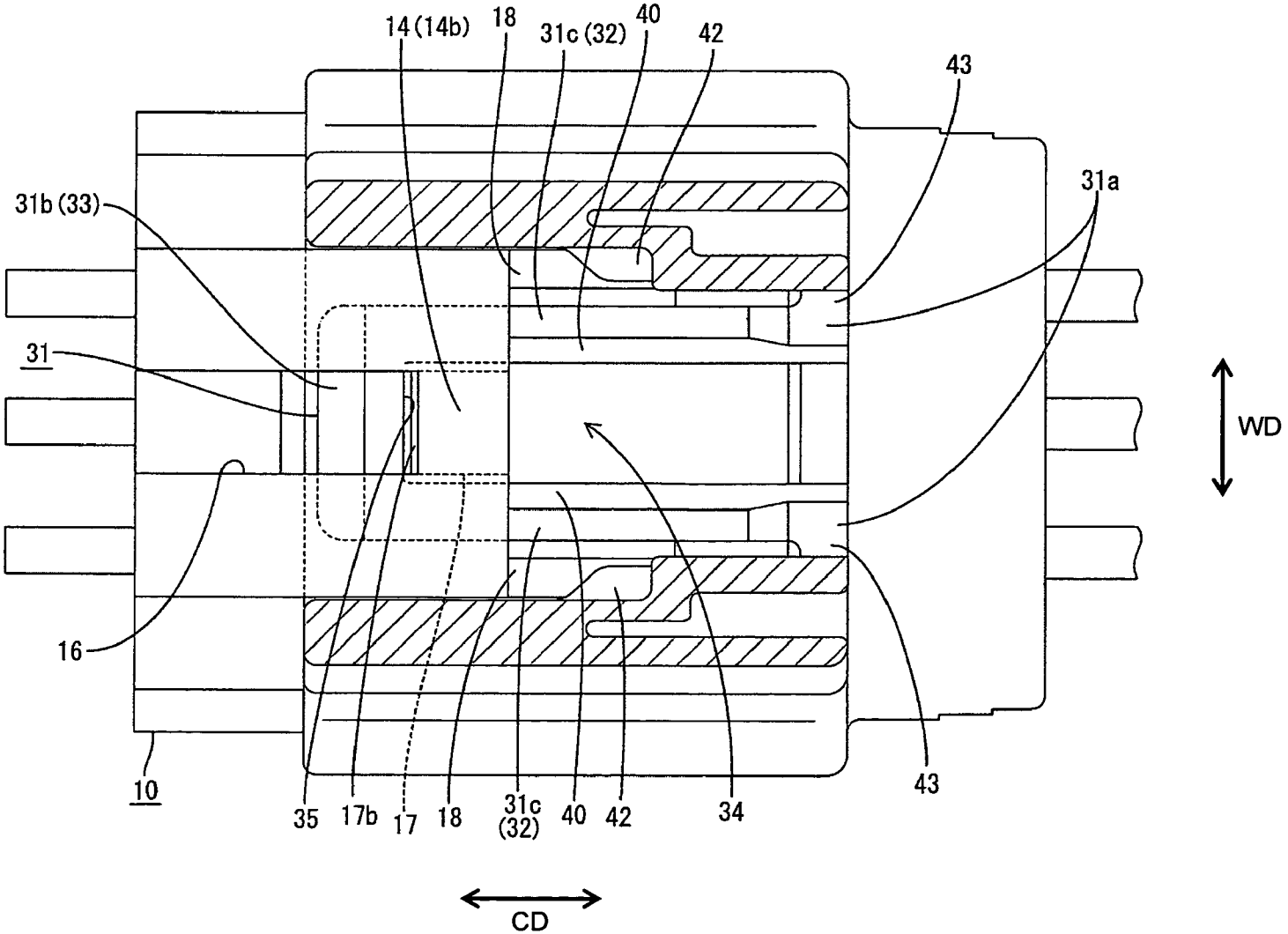
FIG. 10 is a section along X-X of FIG. 6 showing the where the two housings are properly connected.

The free end 31*b* of the lock arm 31 slips under the lock 17 when the two housings 10, 20 are connected to a proper depth. Thus, the lock arm 31 is restored resiliently and the locking surface 35 of the lock arm 31 engages the engaging surface 17*b* of the lock 17, as shown in FIGS. 8 to 10. Thus, the two housings 10, 20 are held in their connected state. The bridging wall 14*b* of the interlocking portion 14 is arranged on a path of a resilient restoring movement of the lock arm 31. Thus, the upper surface of the lock arm 31 collides with the inner surface of the bridging wall 14*b* before the lock arm 31 is restored resiliently to its natural state. The hitting sound generated by this collision provides the operator with a tactile and audible indication that the housings 10, 20 are properly connected. It should be noted that the lock arm 31 may be held slightly deflected from the natural state in the connected state.

As described above, the operator cannot contact the lock arm 31 while the lock arm 31 is being restored resiliently during a connecting operation. Thus, the resilient deforming and restoring movements of the lock arm 31 are not sluggish, and a hitting sound is generated reliably at proper connection. Accordingly, a good tactile feeling can be obtained and a connection error, such as partial connection, can be prevented.

Figure 11:
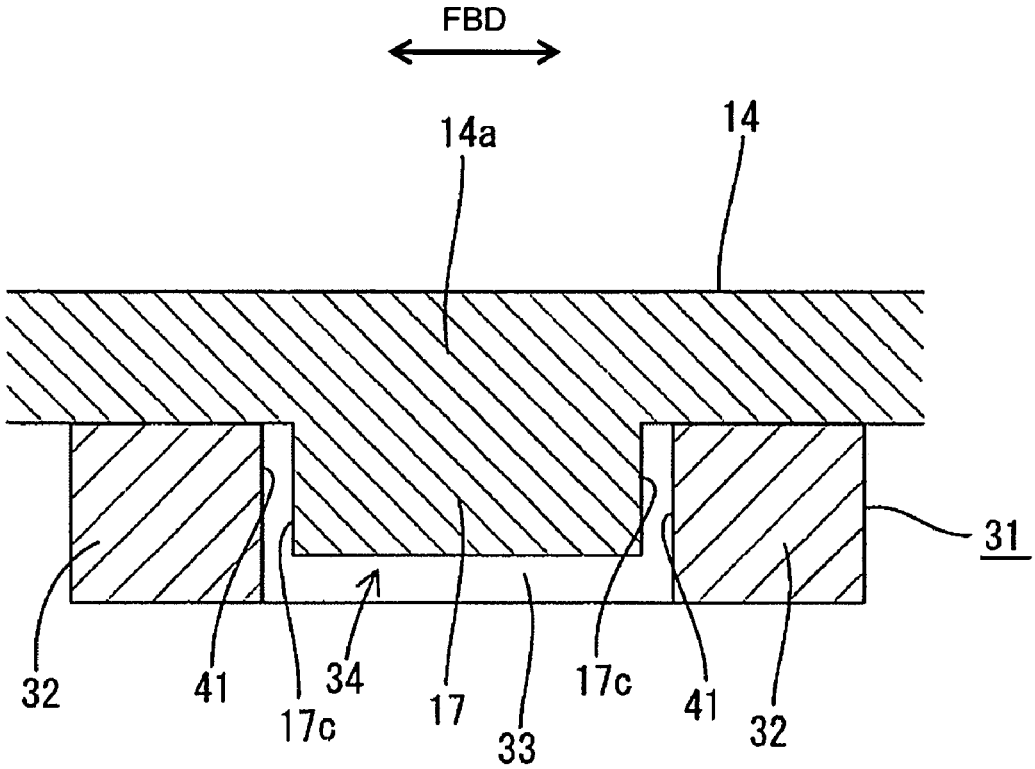
FIG. 11 is a section along Y-Y of FIG. 8.

If bevels were formed on the facing surfaces 41 of the beams 32, the lock arm 31 could be guided by the bevels 40 and displaced in the unlocking direction when the two housings 10, 20 shake in the width directions WD relative to each other within the range of the clearance. However, the opposite side surfaces 17*c* of the lock 17 and the surfaces 41 of the beams 32 facing the side surfaces 17*c* are straight vertical surfaces that are parallel to each other, as shown in FIG. 11. Therefore, shaking will not cause the lock arm to displace in a separating direction.

The locked state of the lock arm 31 must be canceled to separate the two connected housings 10, 20. For this purpose, the finger F of the operator, a jig or the like is inserted into the unlocking space 38 in the female housing 20 from above. The bridging wall 14*b* of the interlocking portion 14 and the second lock protecting portion 37 guide the finger F towards the middle part 31*c* of the lock arm 31, both of which project up towards the front with respect to the inserting direction of the lock arm 31. The inserted finger F contacts the intermediate part 31*c* of the lock arm 31 and enters the clearance 34 between the two beams 32 communicating with the unlocking space 38. The lock arm 31 is deformed resiliently down in its deformation direction by pushing the finger F further down in this state, as shown in FIG. 12.

Figure 13:
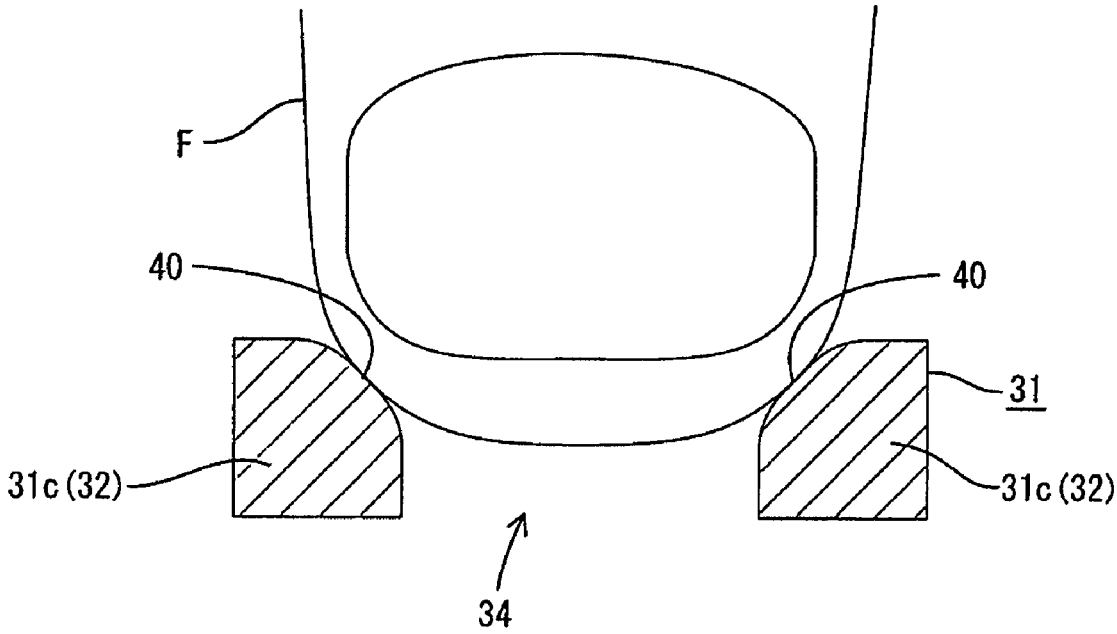
FIG. 13 is a section along Z-Z of FIG. 12.

Inner edges of both beams 32 are pressed evenly, as shown in FIG. 13, so that an operating force can be given to the lock arm 31 in a well-balanced manner with respect to the width direction WD. Further, the bevels 40 are formed on the parts of the beams 32 to be pressed and the finger F of the operator comes into surface contact with the bevels 40. Therefore local pressure acting on the finger F of the operator during the unlocking operation is reduced to mitigate pain to the operator. Therefore, operation efficiency can be improved even if the separating operation is performed repeatedly.

Figure 12:
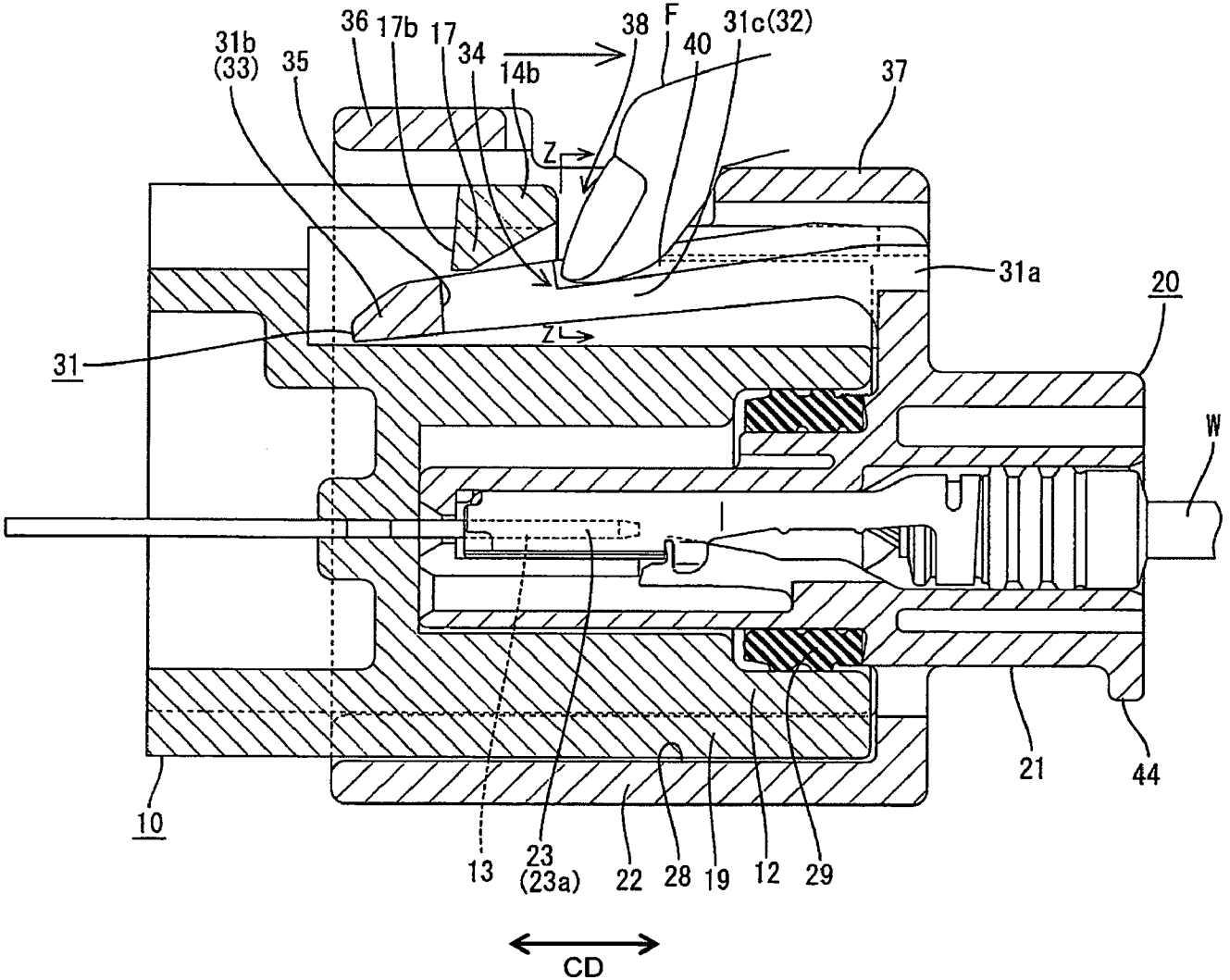
FIG. 12 is a side view in section showing a state where a lock arm is resiliently deformed in unlocking direction.

The lock arm 31 can be deformed to a position where the free end 31*b* is below the lock 17 and disengaged completely from the lock 17, as shown in FIG. 12. The female housing 20 then can be pulled performed by placing the finger F that presses the lock arm 31 on the front end of the second lock protecting wall 37. Therefore operability is good. It should be noted that a tool may be inserted into the unlocking space 38 to perform the unlocking operation.

As described above, the first lock protecting wall 36 covers parts of the lock arm 31 adjacent the free end 31*b*. The second lock protecting wall 37 covers parts of the lock arm 31 including the base ends 31*a* and is arranged at a position to define the unlocking space 38 for exposing the intermediate part 31*c* of the lock arm 31. Thus, the finger F of the operator holding the female housing 20 cannot touch the movable part of the lock arm 31 during the connecting operation. Therefore, good tactile feeling is obtained upon during the connecting operation, with the result that operability can be improved.

The displacing direction of the lock arm 31 for unlocking is opposite to the opening direction of the unlocking space 38. Thus, the locked state can be canceled easily by pressing the middle part 31*c* of the lock arm 31 through the unlocking space 38 for separating the two housings 10, 20.

The lock arm 31 has the two beams 32 facing each other while defining the clearance 34 that communicates with the unlocking space 38 and the coupling portion 33 coupling the free ends of the beams 32. Thus, the finger F or the like can be inserted into the clearance 34 between the two beams 32 during the unlocking operation. Therefore the position of operating the lock arm 31 can be controlled with respect to the width direction. This makes it easier to deform the lock arm 31 in unlocking direction.

The bevels 40 are on the corners of the both beams 32 of the lock arm 31 facing each other and facing the unlocking space 38. Thus, pain felt by the operator when the operator presses the arms 32 can be mitigated, which can contribute to an improvement in operability.

The lock 17 is between the arms 32 when the two housings 10, 20 are connected properly. The bevels 40 are behind the lock 17 in the properly connected state. The facing surfaces 41 of the beams 32 facing the lock 17 have no bevels 40 and are substantially parallel with the side surfaces 17*c*, which are facing surfaces of the lock 17. Therefore, even if the two housings 10, 20 in the connected state shake in width directions WD relative to each other within the range of the clearance, the lock arm 31 is not displaced in the unlocking direction.

Further, the bridging wall 14*b* of the interlocking portion 14 of the male housing 10 faces the unlocking space 38 with the two housings 10, 20 properly connected and doubles as the unlocking-operation guide projecting more in the opening direction of the unlocking space 38 than the lock arm 31. Thus, the finger F or the like being inserted into the unlocking space 38 can be guided by the bridging wall 14*b* and the second lock protecting wall 37, whereby operability can be further improved.

The bridging wall 14*b* of the interlocking portion 14 of the male housing 10 is arranged on the path of the resilient restoring movement of the lock arm 31 at the time of the proper connection and doubles as a hitting-sound generating portion for generating a hitting sound as the lock arm 31 collides. The operator knows by the hitting sound that the proper connection has been reached, whereby the tactile feeling can be even improved.

The invention is not limited to the above described and illustrated embodiment. For example, the following embodiments are also embraced by the technical scope of the present invention as defined by the claims.

Although the operator unlocks the lock arm with his finger in the foregoing embodiment, the lock arm may be unlocked using a jig or tool.

The second lock protecting wall is lower position than the first lock protecting wall in the foregoing embodiment. However, both lock protecting walls may be at substantially the same heights or, conversely, the second lock protecting wall may be higher than the first lock protecting wall. In short, the heights of the lock protecting walls can be changed as long as consideration is given to prevent the finger of the operator or external matter from entering the clearances between the lock arm and the respective lock protecting walls to interfere with the lock arm. The shapes and/or lengths in forward and backward directions FBD of the respective lock protecting walls also can be changed.

The lock arm has a forked configuration defined by the two beams in the foregoing embodiment. However, a lock arm may have one beam without being forked in accordance with the invention. In such a case, a hole or recess may penetrate the lock arm vertically, but without an open rear side, and the lock may enter this hole for locking engagement.

The lock projects from the bridging wall of the interlocking portion and the lock arm is formed with a recess having a space for receiving the lock in the foregoing embodiment. However, the arrangement of the projection and recess may be reversed. Specifically, a projection may project up from the upper surface of the lock arm, and a groove may be formed in the bridging wall of the interlocking portion and may receive the projection for locking engagement according to the invention.

Chamfered bevels are provided on the lock arm in the foregoing embodiment. However, rounded bevels may be provided, and beveled portions with other shapes also may be provided, such as a wavy shape. Further, the range of the beveled portions on the lock arm in forward and backward directions can be changed. Furthermore, lock arms having no bevels also are embraced by the present invention.

The lock arm is not restored resiliently to its natural state at the time of the proper connection in the foregoing embodiment. However, it may be set to be restored resiliently substantially to its natural state.

The groove is formed up to the bridging wall in the interlocking portion in the foregoing embodiment. However, the range of the groove may not extend up to the bridging wall according to the present invention since it is sufficient if a mold for forming the interlocking surface of the lock projecting from the bridging wall can be removed upon resin-molding the male housing.

The displacing direction of the lock arm for the unlocking operation and the opening direction of the unlocking space are opposite in the foregoing embodiment. However, both directions may be the same according to the invention. In such a case, the lock arm may be pulled using the finger or jig inserted into the unlocking space.

The male housing is connected directly with the device in the foregoing embodiment. However, the male housing may be constructed to accommodate male terminal fittings connected with ends of wires.

In the foregoing embodiment, the female housing has the lock arm, both lock protecting portions and the unlocking space and the male housing is has the lock. Conversely, the male housing may be provided with the lock arm, while both lock protecting walls and unlocking space and the female housing may be provided with the lock according to the invention.

A connector with a fluid- or waterproof function is illustrated in the foregoing embodiment. However, the invention is also applicable to non-fluidtight or non-watertight connectors.

What is claimed is:

1. A connector, comprising:

a housing including a wall with opposite front and rear ends spaced apart along a connecting direction, a resiliently deformable lock arm having a base end in proximity to the rear end of the wall, the lock arm being cantilevered forwardly from the base end substantially along the connecting direction, the lock arm further having a free end in proximity to the front end of the wall;

a first lock protecting portion for at least partly covering a first portion of the lock arm in proximity to the free end of the lock arm so that the first portion of the lock arm is between the first lock protecting portion and the wall of the housing; and a second lock protecting portion at least partly covering a second portion of the lock arm in proximity to the base end of the lock arm so that the second portion of the lock arm is between the second lock protecting portion and the wall of the housing, the second lock protecting portion being disposed relative to the first lock protecting portion to define an unlocking space exposing an intermediate part of the lock arm to the outside.

2. The connector of claim 1, wherein a displacing direction of the lock arm being unlocked is substantially opposite to an opening direction of the unlocking space.

3. The connector of claim 1, wherein the lock arm has two beams substantially facing each other while defining a clearance substantially communicating with the unlocking space and a coupling coupling the free ends of the both beams.

4. The connector of claim 1, wherein the housing comprises auxiliary supports coupled to portions of the lock arm so that the portions of the lock arm have surfaces thereof coupled to and supported on at least one portion of the housing.

5. A connector, comprising:

a housing connectable with a mating housing along a connecting direction;

a resiliently deformable lock arm cantilevered from the housing and extending substantially along the connecting direction, the lock arm being deformable in the process of connecting the housing with the mating housing and resiliently restoring upon proper connection of the housings to engage a lock of the mating housing for holding the housing connected with the mating housing, a first lock protecting portion formed on the housing for at least partly covering a free end of the lock arm and a second lock protecting portion formed on the housing and at least partly covering a base end of the lock arm, the second lock protecting portion being disposed relative to the first lock protecting portion to define an unlocking space exposing an intermediate part of the lock arm to the outside, the lock arm having two beams substantially facing each other while defining a clearance substantially communicating with the unlocking space and a coupling coupling free ends of the beams, wherein bevels are provided in correspondence with corners of the beams substantially facing each other and substantially facing the unlocking space.

6. The connector of claim 5, wherein the lock is configured for entering the clearance between the beams when the housing is connected properly with the mating housing.

7. The connector of claim 6, wherein the bevels are arranged behind the lock in a properly connected state, and surfaces of the beams facing the lock are substantially parallel to facing surfaces of the lock.

8. A connector assembly comprising, a housing and a mating housing that are connectable along a connecting direction;

the housing including a resiliently deformable lock arm having a base end joined to a wall of the housing and having a deflectable portion cantilevered from the base end and extending substantially along the connecting direction, the lock arm being deformable in the process of connecting the housing with the mating housing and resiliently restoring upon proper connection of the housings to engage a lock of the mating housing for holding the housing connected with the mating housing, wherein the housing further includes a first lock protecting portion for at least partly covering a free end of the lock arm so that the free end of the lock arm is between the wall of the housing and the first lock protecting portion, and a second lock protecting portion at least partly covering a portion of the lock arm in proximity to the base end of the lock arm so that the portion of the lock arm in proximity to the base end of the lock arm is between the wall and the second lock protecting portion, the second lock protecting portion being disposed relative to the first lock protecting portion to define an unlocking space between the first and second lock protecting portions for exposing an intermediate part of the lock arm to the outside.

9. The connector assembly of claim 8, wherein the mating housing includes at least one unlocking-operation guiding portion substantially facing the unlocking space with the two housings properly connected and projecting more in the opening direction of the unlocking space than the lock arm.

10. The connector assembly of claim 8, wherein the mating housing includes at least one hitting-sound generating portion arranged on a path of a resilient restoring movement of the lock arm at least at the time of the substantially proper connection and adapted to generate a hitting sound as the lock arm collides therewith.

* * * * *